US009472323B2

(12) United States Patent
Huang et al.

(10) Patent No.: US 9,472,323 B2
(45) Date of Patent: Oct. 18, 2016

(54) DIFFERENTIAL SIGNAL TRANSMISSION CABLE AND DIFFERENTIAL SIGNAL TRANSMISSION AGGREGATED CABLE

(71) Applicant: HITACHI METALS, LTD., Tokyo (JP)

(72) Inventors: Detian Huang, Hitachi (JP); Masanori Kobayashi, Hitachi (JP); Risa Akiyama, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/584,325

(22) Filed: Dec. 29, 2014

(65) Prior Publication Data

US 2015/0310966 A1 Oct. 29, 2015

(30) Foreign Application Priority Data

Apr. 25, 2014 (JP) ..... 2014-091143

(51) Int. Cl.
*H01B 11/00* (2006.01)
*H01B 11/20* (2006.01)

(52) U.S. Cl.
CPC ..... *H01B 11/203* (2013.01)

(58) Field of Classification Search
CPC ..... H01B 11/04; H01B 7/08
USPC ..... 174/113 R, 117 F
See application file for complete search history.

(56) References Cited

U.S. PATENT DOCUMENTS

2010/0307790 A1* 12/2010 Okano ..... H01B 7/361 174/113 C
2011/0232941 A1* 9/2011 Sugiyama ..... H01B 11/203 174/250
2013/0087361 A1* 4/2013 Kaga ..... H01B 3/441 174/102 R
2014/0014410 A1* 1/2014 Tanaka ..... H01R 4/00 174/84 R
2014/0182881 A1* 7/2014 Huang ..... H01B 11/1091 174/103

FOREIGN PATENT DOCUMENTS

JP 2011-090959 A 5/2011

* cited by examiner

*Primary Examiner* — Chau N Nguyen
(74) *Attorney, Agent, or Firm* — Foley & Lardner LLP

(57) ABSTRACT

A differential signal transmission cable is composed of a Twinax cable including twin electrically insulated wires, which are arranged side by side in contact with each other, and a drain wire, which is arranged in contact with and parallel to both of the twin electrically insulated wires, and a shield tape, which is wound around a circumference of the Twinax cable including the drain wire. When in cross sectional view, an isosceles triangle is defined as having, as its base, a line segment that joins respective centers of the twin electrically insulated wires, and as its vertex point, a center of the drain wire, the isosceles triangle has a vertex angle of not smaller than 74 degrees and not greater than 90 degrees.

5 Claims, 3 Drawing Sheets

DIFFERENTIAL SIGNAL TRANSMISSION CABLE AND DIFFERENTIAL SIGNAL TRANSMISSION AGGREGATED CABLE

The present application is based on Japanese patent application No. 2014-091143 filed on Apr. 25, 2014, the entire contents of which are incorporated herein by reference.

BACKGROUND OF THE INVENTION

1. Field of the Invention

This invention relates to a differential signal transmission cable and a differential signal transmission aggregated cable, which are designed for as high frequency signal transmission as a few GHz or higher in a differential manner.

2. Description of the Related Art

For high frequency signal transmission at a few GHz or higher, differential signal transmission has been adopted. In the differential signal transmission, two phase-inverted (180 degrees out of phase) signals are transmitted in twin electrically insulated wires respectively, and at a receiving end of the twin electrically insulated wires, a difference between the two signals is synthesized and output. In the differential signal transmission, directions of flow of currents through the twin electrically insulated wires are opposite each other. The differential signal transmission therefore allows for decreasing outward electromagnetic radiation. Also, because noise is superimposed equally on the twin electrically insulated wires, the differential signal transmission allows for cancelling out effects of the noise at the receiving end of the twin electrically insulated wires.

As a transmission path for as high frequency signal transmission at a few GHz or higher, a conventional differential signal transmission cable 300 as shown in FIG. 3 is known that comprises a Twinax cable 303 including twin electrically insulated wires 301, which are arranged side by side in contact with each other, and a drain wire 302, which is arranged in contact with and parallel to both of the twin electrically insulated wires 301, and a shield tape 304, which is wound around a circumference of that Twinax cable 303 including the drain wire 302.

Refer to e.g., JP-A-2011-091959.

SUMMARY OF THE INVENTION

In order for a high frequency signal on the order of 10 GHz to be transmitted without significant attenuation, an intra-pair propagation delay time difference (intra-pair skew) is required to be not larger than 10 ps/m, but the intra-pair propagation delay time difference in a static condition of the conventional differential signal transmission cable 300 has varied in a wide range of approximately not smaller than 7 ps/m and not larger than 12 ps/m. Due to this, no differential signal transmission cable 300 having the small intra-pair propagation delay time difference has stably been able to be produced.

Also, when even the differential signal transmission cable 300 having the intra-pair propagation delay time difference in the static condition of not larger than 10 ps/m has been bent or when a plurality of the differential signal transmission cables 300 have been aggregated and cabled, the intra-pair propagation delay time difference thereof has degraded to the range of approximately not smaller than 15 ps/m and not larger than 22 ps/m.

Accordingly, it is an object of the present invention to provide a differential signal transmission cable and a differential signal transmission aggregated cable, which are small in intra-pair propagation delay time difference in a static condition, and small in intra-pair propagation delay time difference when bent or after cabling as well, as compared with conventional art.

(1) According to one embodiment of the invention, a differential signal transmission cable comprises:

a Twinax cable including twin electrically insulated wires, which are arranged side by side in contact with each other, and a drain wire, which is arranged in contact with and parallel to both of the twin electrically insulated wires; and a shield tape, which is wound around a circumference of the Twinax cable including the drain wire, wherein when in cross sectional view, an isosceles triangle is defined as having, as its base, a line segment that joins respective centers of the twin electrically insulated wires, and as its vertex point, a center of the drain wire, the isosceles triangle has a vertex angle of not smaller than 74 degrees and not greater than 90 degrees.

In one embodiment, the following modifications and changes may be made.

(i) The electrically insulated wires include a respective signal wire conductor, and a respective solid insulating layer formed around a circumference of the signal wire conductor, and the respective solid insulating layer has a Shore hardness of not lower than D50 and not higher than D65, and a coefficient of kinetic friction of its outer surface of not lower than 0.1 MPa, 3 m/min and not higher than 0.3 MPa, 3 m/min.

(ii) The drain wire is formed by stranding a plurality of ground wire strands together.

(iii) The shield tape is wound in an opposite direction to a direction of the stranding of the ground wire strands.

(2) According to another embodiment of the invention, a differential signal transmission aggregated cable is formed by aggregating together a plurality of the differential signal transmission cables as specified above.

(Points of the Invention)

The present invention allows for providing the differential signal transmission cable and the differential signal transmission aggregated cable, which are small in intra-pair propagation delay time difference in a static condition, and small in intra-pair propagation delay time difference when bent or after cabling as well, as compared with conventional art.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment according to the invention, in conjunction with the accompanying drawings.

Figure 1:
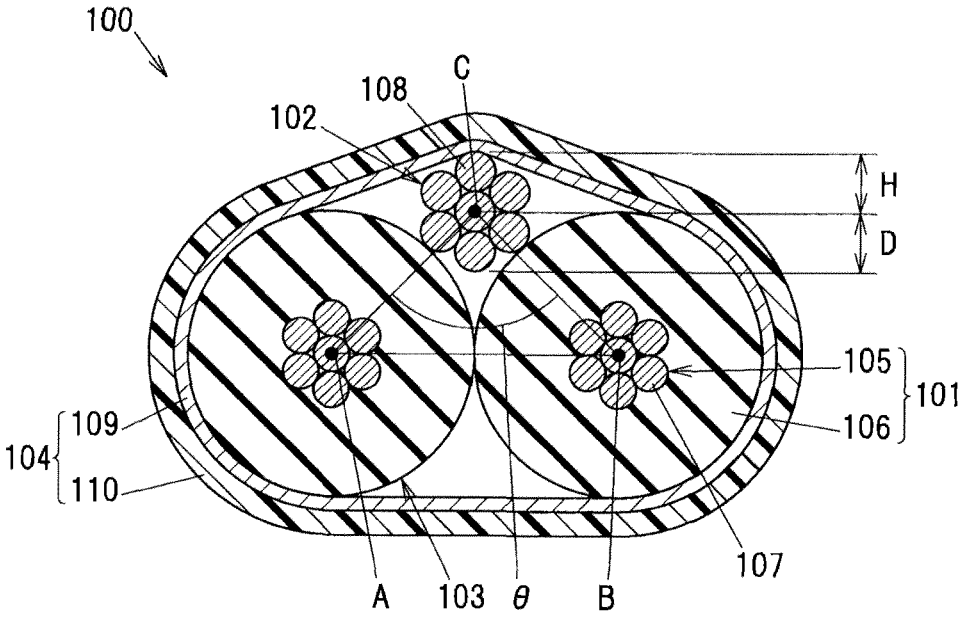
FIG. 1 is a cross sectional schematic view showing a differential signal transmission cable according to the present invention.

As shown in FIG. 1, a differential signal transmission cable 100 in the preferred embodiment of the present invention is composed of a Twinax cable 103 including twin electrically insulated wires 101, which are arranged side by side in contact with each other, and a drain wire 102, which is arranged in contact with and parallel to both of the twin electrically insulated wires 101, and a shield tape 104, which is wound around a circumference of the Twinax cable 103 including the drain wire 102.

The electrically insulated wires 101 include a respective signal wire conductor 105 and a respective solid insulating layer 106 formed around a circumference of the signal wire conductor 105.

The signal wire conductors 105 are composed of, e.g., a stranded wire, which is formed by stranding seven signal wire strands 107 together. This allows for enhancing the bending resistance of the signal wire conductors 105, and also increasing the surface area thereof to mitigate the skin effect due to high frequency signal transmission, in comparison with when the signal wire conductors 105 are made of a solid wire.

The solid insulating layers 106 have a Shore hardness of not lower than D50 and not higher than D65, and a coefficient of kinetic friction of their respective outer surfaces of not lower than 0.1 MPa, 3 m/min and not higher than 0.3 MPa, 3 m/min. A reason for setting the Shore hardnesses of the solid insulating layers 106 at not lower than D50 and not higher than D65 is because if the Shore hardnesses of the solid insulating layers 106 are lower than D50, the solid insulating layers 106, when the drain wire 102 is pressed down with the shield tape 104, are likely to be flattened by the drain wire 102, thus losing their impedance match, and because if the Shore hardnesses of the solid insulating layers 106 are higher than D65, the electrically insulated wires 101 are likely to be generally hard, and lower in flexibility. Also, a reason for setting the coefficients of kinetic friction of the respective outer surfaces of the solid insulating layers 106 at not lower than 0.1 MPa, 3 m/min and not higher than 0.3 MPa, 3 m/min is because if the coefficients of kinetic friction of the respective outer surfaces of the solid insulating layers 106 are lower than 0.1 MPa, 3 m/min, the drain wire 102 is likely to be displaced from its predetermined location, leading to a variation in the distance between the drain wire 102 and the two signal wire conductors 105, and an increase in the intra-pair propagation delay time difference, and because if the coefficients of kinetic friction of the respective outer surfaces of the solid insulating layers 106 are higher than 0.3 MPa, 3 m/min, stress which acts on the electrically insulated wires 101 when the differential signal transmission cable 100 is bent is likely to be unable to be well dispersed, thus causing a wire break. etc. As a material for the solid insulating layers 106 to satisfy these properties, e.g., fluorine resins such as tetratluoroethylene perfluoroalkyl vinyl ether copolymer (PFA), tetrailuoroethylene hexafluoropropylene copolymer (FFP), polytetratluoroethylene (PTFE) may be used.

Note that no foamed insulating layer is preferably employed as the insulating layers for the electrically insulated wires 101 due to its tendency to be flattened and deformed by the drain wire 102.

It is preferable that the drain wire 102 is formed by stranding a plurality (e.g., seven) of ground wire strands 108 together. This allows for increasing the frictional force between the drain wire 102 and the electrically insulated wires 101, thereby preventing the drain wire 102 from being displaced from its predetermined location.

The shield tape 104 includes an inner layer 109 made of a metal and an outer layer 110 made of a resin. As a material for the inner layer 109, e.g. copper foil may be used.

It is preferable that the shield tape 104 is wound in an opposite direction to a direction of the stranding of the ground wire strands 108. This allows for securely pressing the drain wire 102 against the electrically insulated wires 101, thereby preventing the drain wire 102 from being displaced from its predetermined location.

The outer layer 110 acts to reinforce the inner layer 109 having low mechanical strength, tightly presses the drain wire 102 against the electrically insulated wires 101 to prevent the drain wire 102 from being displaced from its predetermined location, and also protects the differential signal transmission cable 100 from damage.

Now, the differential signal transmission cable 100 in the present embodiment is characterized in that when in its cross sectional view, an isosceles triangle ABC is defined as having, as its base, a line segment AB that joins respective centers A and B of the twin electrically insulated wires 101, and as its vertex point, a center C of the drain wire 102, the isosceles triangle ABC has a vertex angle θ of not smaller than 74 degrees and not greater than 90 degrees.

In order to decrease the vertex angle θ of the isosceles triangle ABC, it is necessary to increase an outer diameter of the drain wire 102 relative to a respective outer diameter of the electrically insulated wires 101. Therefore, if the vertex angle θ of the isosceles triangle ABC is smaller than 74 degrees, an embedment depth D of the drain wire 102 is too shallow, thus being likely to cause the drain wire 102 to be displaced from its predetermined location.

Also, in order to increase the vertex angle θ of the isosceles triangle ABC, it is necessary to decrease the outer diameter of the drain wire 102 relative to the respective outer diameter of the electrically insulated wires 101. Therefore, if the vertex angle θ of the isosceles triangle ABC is greater than 90 degrees, the embedment depth D of the drain wire 102 is deep, but a protrusion height H of the drain wire 102 is too low, thus causing the drain wire 102 to be unable to be tightly pressed against the electrically insulated wires 101, and being likely to cause the drain wire 102 to be displaced from its predetermined location.

As described above, because in the differential signal transmission cable 100, the vertex angle θ of the isosceles triangle ABC is not smaller than 74 degrees and not greater than 90 degrees, the drain wire 102 is unlikely to be displaced from its predetermined location. Thus, the differential signal transmission cable 100 can be small in the intra-pair propagation delay time difference in a static condition, and small in the intra-pair propagation delay time difference when bent or after cabling as well, as compared with the conventional art.

For example, the conventional differential signal transmission cable 300 is approximately not smaller than 7 ps/m and not larger than 12 ps/m in the intra-pair propagation delay time difference in the static condition, and approximately not smaller than 15 ps/m and not larger than 22 ps/m in the intra-pair propagation delay time difference when bent or after cabling, whereas the differential signal transmission cable 100 can be approximately not smaller than 5 ps/m and not larger than 6 ps/m in the intra-pair propagation delay time difference in the static condition, and approximately not smaller than 5 ps/m and not larger than 7 ps/m in the intra-pair propagation delay time difference when bent or after cabling, in other words, the differential signal transmission cable 100 has little change in the intra-pair propagation delay time difference in the static condition and the other conditions.

For that reason, the differential signal transmission cable 100 allows its attenuation curve, which shows a change in loss due to signal frequencies, to be a gentle curve with no suck out, in comparison with the conventional differential signal transmission cable 300, and allows for a high frequency signal on the order of 10 GHz to be optimally transmitted therein.

Figure 2:
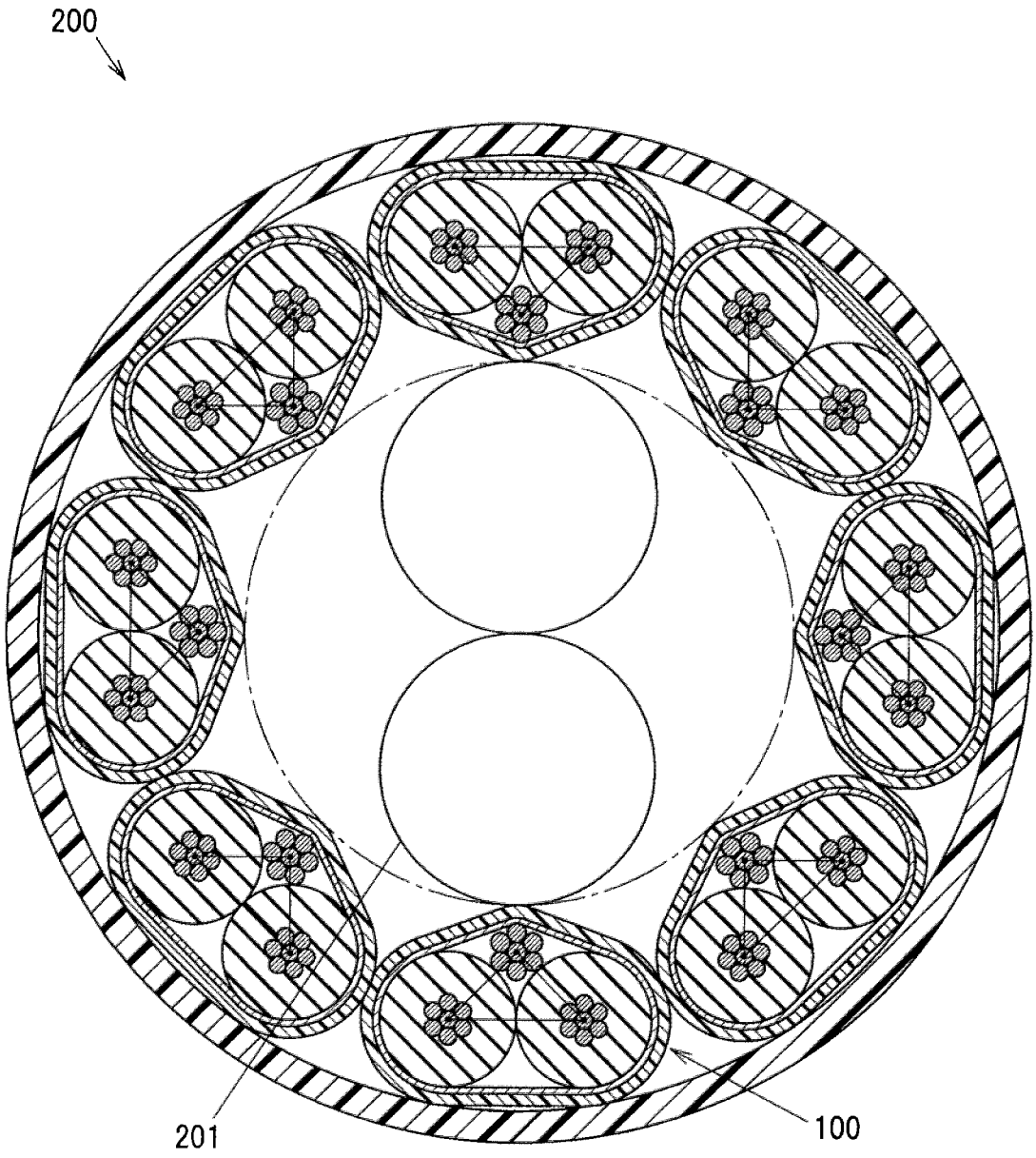
FIG. 2 is a cross sectional schematic view showing a differential signal transmission aggregated cable according to the present invention.
Figure 3:
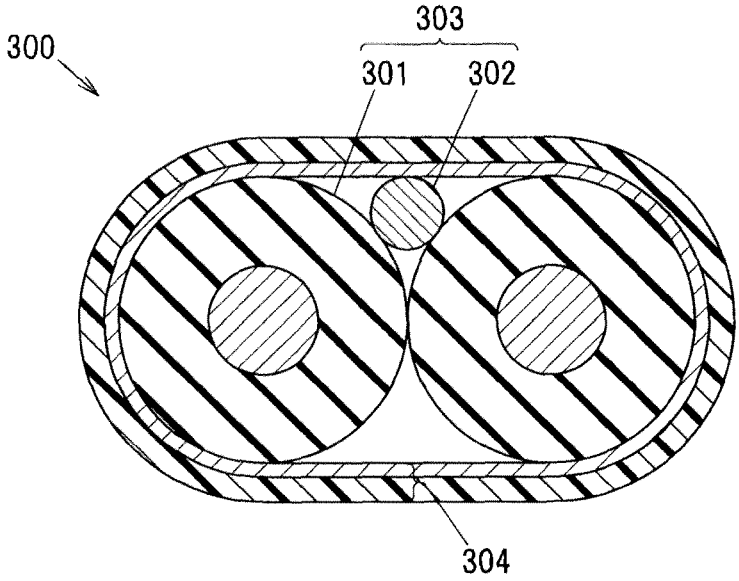
FIG.3 PRIOR ART
FIG. 3 is a cross sectional schematic view showing a differential signal transmission cable in conventional art.

Note that because as described previously, the differential signal transmission cable 100 is small in the intra-pair propagation delay time difference after cabling, it is possible to produce a differential signal transmission aggregated cable 200, which is small in the intra-pair propagation delay time difference, as compared with the conventional art, by, as shown in FIG. 2, aggregating a plurality (e.g., eight) of the differential signal transmission cables 100 (e.g., stranding them together with another cable 201).

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A differential signal transmission cable, comprising:

a Twinax cable including twin electrically insulated wires, which are arranged side by side in contact with each other, and a drain wire, which is arranged in contact with and parallel to both of the twin electrically insulated wires; and a shield tape, which is wound around a circumference of the Twinax cable including the drain wire, wherein when in cross sectional view, an isosceles triangle is defined as having, as its base, a line segment that joins respective centers of the twin electrically insulated wires, and as its vertex point, a center of the drain wire, the isosceles triangle has a vertex angle of not smaller than 74 degrees and not greater than 90 degrees, and wherein the electrically insulated wires include a respective signal wire conductor, and a respective solid insulating layer formed around a circumference of the signal wire conductor, and the respective solid insulating layer has a Shore hardness of not lower than D50 and not higher than D65, and a coefficient of kinetic friction of its outer surface of not lower than 0.1 MPa, 3 m/min and not higher than 0.3 MPa, 3 m/min.

2. The differential signal transmission cable according to claim 1, wherein the drain wire is formed by stranding a plurality of ground wire strands together.

3. A differential signal transmission aggregated cable, which is formed by aggregating together a plurality of the differential signal transmission cables according to claim 1.

4. A differential signal transmission cable, comprising:

a Twinax cable including twin electrically insulated wires, which are arranged side by side in contact with each other, and a drain wire, which is arranged in contact with and parallel to both of the twin electrically insulated wires; and a shield tape, which is wound around a circumference of the Twinax cable including the drain wire, wherein when in cross sectional view, an isosceles triangle is defined as having, as its base, a line segment that joins respective centers of the twin electrically insulated wires, and as its vertex point, a center of the drain wire, the isosceles triangle has a vertex angle of not smaller than 74 degrees and not greater than 90 degrees, wherein the drain wire is formed by stranding a plurality of ground wire strands together, and wherein the shield tape is wound in an opposite direction to a direction of the stranding of the ground wire strands.

5. A differential signal transmission aggregated cable, which is formed by aggregating together a plurality of the differential signal transmission cables according to claim 4.

* * * * *